US005165061A

United States Patent [19]

Witteveen

[11] Patent Number: 5,165,061

[45] Date of Patent: Nov. 17, 1992

[54] STACKABLE DROP GENERATOR FOR AN INK-JET PRINTER

[75] Inventor: Bontko Witteveen, EC Venlo, Netherlands

[73] Assignee: Oce-Nederland B.V., Venlo, Netherlands

[21] Appl. No.: 624,331

[22] Filed: Dec. 7, 1990

[30] Foreign Application Priority Data

Dec. 8, 1989 [NL] Netherlands ..... 8903025

[51] Int. Cl.[5] ..... B41J 2/045

[52] U.S. Cl. ..... 346/140 R

[58] Field of Search ..... 346/140 R, 75

[56] References Cited

U.S. PATENT DOCUMENTS

| | | | |
|---|---|---|---|
| 3,946,398 | 3/1976 | Kyser et al. | 346/1.1 |
| 3,988,745 | 10/1976 | Sultan | 346/140 R |
| 4,377,814 | 3/1983 | Debesis | 346/140 R |
| 4,385,304 | 5/1983 | Sniderman | 346/140 R |
| 4,392,145 | 7/1983 | Parkola | 346/140 R |
| 4,455,560 | 6/1984 | Louzil | 346/140 R |
| 4,605,939 | 8/1986 | Hubbard et al. | 346/140 R |
| 4,752,789 | 6/1988 | Maltsev | 346/140 R |
| 4,823,149 | 4/1989 | Martner et al. | 3436/140 R |

OTHER PUBLICATIONS

Anschel et al; "Modular Drop-On-Demand Ink Jet Printing"; IBM TDB vol. 20, No. 12 May 1978, pp. 5425-5428.

*Primary Examiner*—Benjamin R. Fuller
*Assistant Examiner*—Alrick Bobb
*Attorney, Agent, or Firm*—Birch, Stewart, Kolasch & Birch

[57] ABSTRACT

A stackable drop generator for an ink-jet printer made up of a number of stackable elements in the form of flat plates, each plate comprising a pressure chamber, a supply chamber and a piezo-element for forming a pressure wave in the ink in the pressure chamber, and in which elements are so disposed on either side of a first or intermediate element such that the pressure chambers of the elements are not in line with the pressure chamber of the intermediate element.

18 Claims, 5 Drawing Sheets

STACKABLE DROP GENERATOR FOR AN INK-JET PRINTER

BACKGROUND OF THE INVENTION

1. Field of the Invention

This invention relates to an ink-jet printer, and more specifically to a stackable drop generator for an ink-jet printer made up of a number of stackable elements in the form of flat plates.

2. Related Prior Art

A drop generator of the stackable plate configuration is disclosed in U.S. Pat. No. 4,385,304. The ink chambers of the adjacent elements are sealed by electrode plates of a thickness of about 0.075 mm. A seal of this thickness offers a good solution to preventing cross-talk for the pressure waves in two adjacent pressure chambers, but stack density decreases greatly as a result so that the resulting drop generator makes prints with a relatively low resolution.

SUMMARY OF THE INVENTION

Therefore, it is an object of the present invention to provide a stackable drop generator which will overcome these and other disadvantages.

It is a further object of the present invention to provide a stackable drop generator for an ink-jet printer including a multiplicity of stackable flat plate elements such that prints made from the ink-jet printer have a relatively high resolution.

The foregoing objects and others are accomplished in accordance with the present invention generally speaking by providing a stackable drop generator made of a number of stackable elements in the form, of flat plates, each plate comprising a pressure chamber an ink supply chamber communicating with the pressure chamber, the pressure chamber being disposed with an opening throughout the element, a piezo-element for forming a pressure wave in the ink in the pressure chamber, a nozzle with an inlet which leads into the pressure chamber and with an outlet through which ink drops can be ejected from the pressure chamber, and openings which are in line with openings in each other element and through which fixing means can be disposed in order to enable the elements to be accurately stacked. The elements are so disposed such that the pressure chambers of the respective elements on either side of an intermediate element are not in line with the pressure chamber of the intermediate element. Consequently, the pressure waves in a respective pressure chamber have no influence on the other or adjacent pressure chambers, so that only a very thin sealing plate, if any, is required between the various elements, and the drop generator stack density increases greatly as a result.

In one embodiment of a stackable drop generator according to the present invention, a first group of identical elements is provided in combination with a second group of identical elements such that none of the ink supply chambers of the first group of identical elements communicates with an ink supply chamber of the elements of the second group, each element of a group having at least one passage opening in line with the ink supply chamber or chambers of the elements of the other group. Consequently, the resulting drop generator can spray inks of different colors simultaneously in order to produce colored prints on a receiving sheet.

BRIEF DESCRIPTION OF THE DRAWINGS

These and other advantages will be explained hereinafter with reference to the accompanying drawings wherein.

DETAILED DISCUSSION

Figure 1:
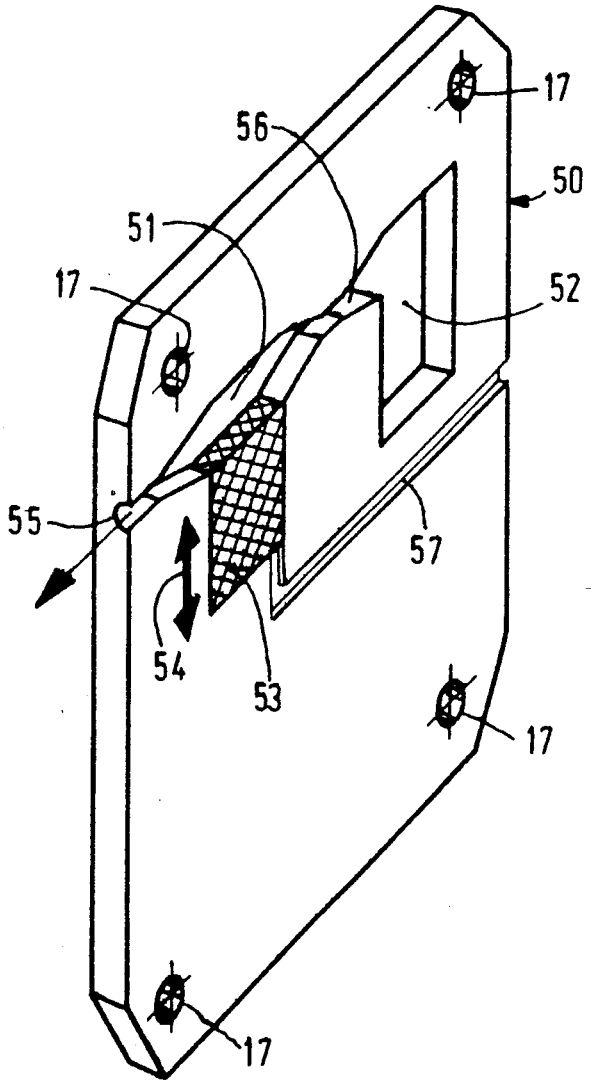
FIG. 1 illustrates an element for a drop generator according to the present invention.

Referring now to FIG. 1 there is seen an element 50 in the form of a flat metal plate measuring about 15×15 mm and 0.1 mm thick provided with four openings 17. An ink supply chamber 52 and a pressure chamber 51 are also provided in this element. A narrow opening 56 is provided between the ink supply chamber 52 and the pressure chamber 51 to allow ink to flow from the supply chamber 52 to the pressure chamber 51. A recess in which a piezo-element 53 is secured, for example by a glue connection, is also provided in the element 50 in communication with the pressure chamber 51. The inlet of nozzle 55 leads into the pressure chamber 51. The piezo-element which is about 0.08 mm thick, has evaporation-applied electrodes (not shown) on both externally facing sides. One electrode is connected to element 50 and the other electrode has a thin connecting foil which is led out via cavity 57 in the element 50.

At the sites where the connecting foil is pressed against the electrode the foil is corrugated to some extent so that there are only a few contact points between the foil and the electrode. By stacking the elements and pressing them on one another the foil will form a kind of spring contact, the total thickness of the assembly made up of the piezo-element 53, electrodes and contact foils having a thickness which corresponds exactly to the thickness of the element 50.

The application of voltage to the piezo-element 53 causes a pressure wave to form in a known manner in the direction of arrow 54 in the ink present in the pressure chamber 51, so that a drop of ink is ejected through nozzle 55.

The openings 17 in the element 50 can be accurately formed by spark erosion.

Nozzle 55 is formed as a channel disposed in one side of the element 50. The dimensions of this channel can be selected as required. The channel is preferably 50 μm deep. The channel forming the nozzle 55 may be provided both in the front and in the rear of the element. A channel of this kind is particularly easy to make and keep clean. Because the entire thickness of the element is not drilled, extra rigidity is obtained for the thin element 50. The opening 56 may have the same shape as the nozzle 55.

Figure 2:
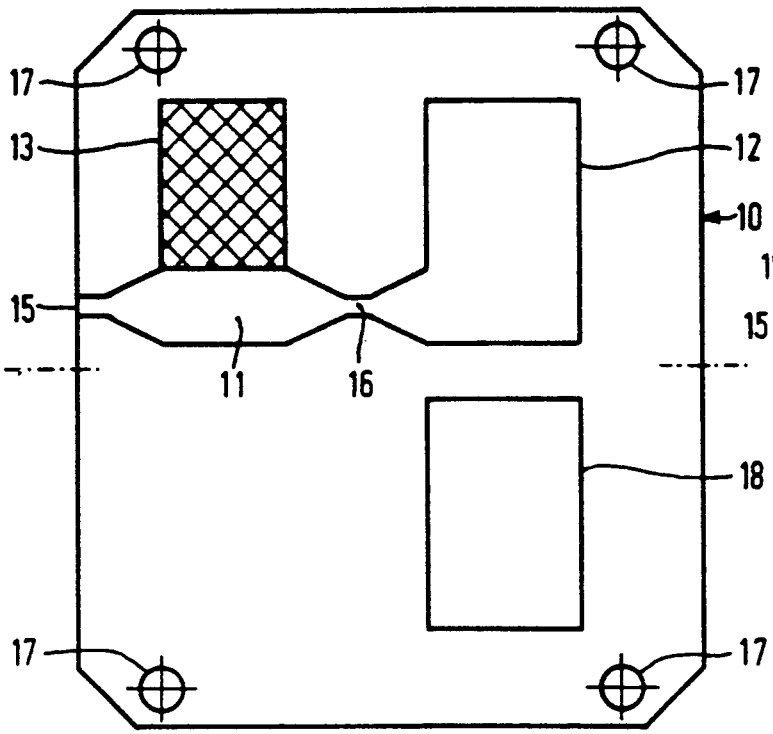
FIG. 2 illustrates another element for a drop generator according to the present invention.

FIG. 2 is a top plan view of an element 10 having approximately the same external dimensions and construction as element 50 in FIG. 1. Element 10 comprises an ink supply chamber 12 communicating with the pressure chamber 11 via opening 16. The piezo-element 13 when actuated can in the manner described eject a drop of ink through the nozzle 15.

Figure 3C:
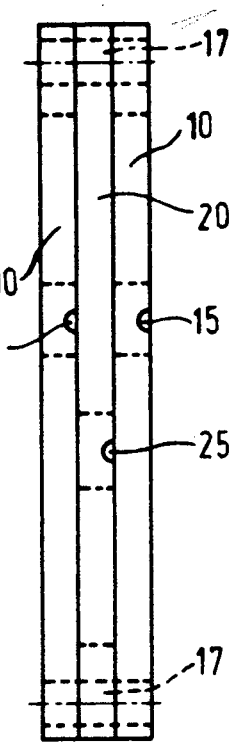
FIG. 3*c* is a side view of an alternate embodiment of the present invention.
Figure 3A:
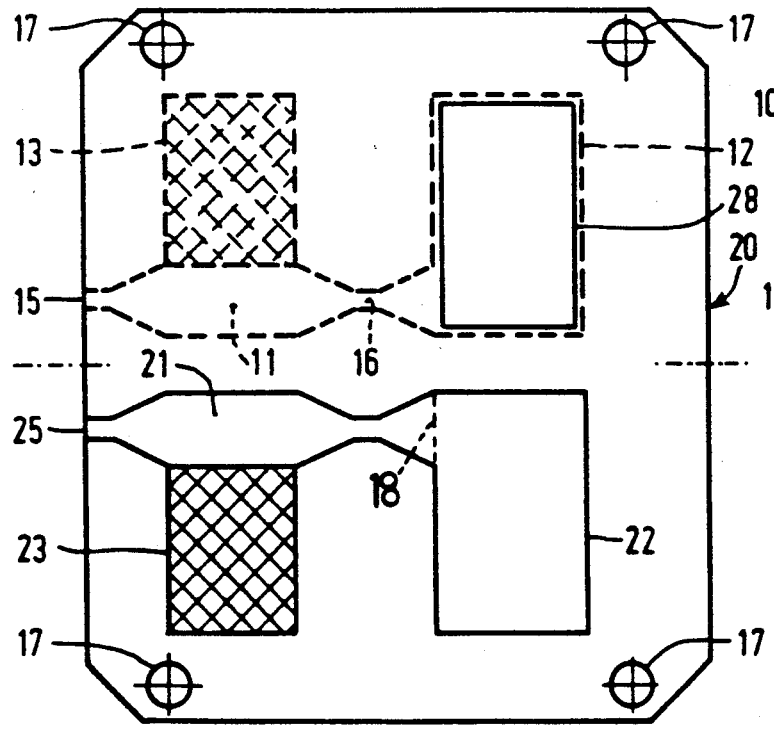
FIG. 3*a* shows two elements fixed on one another in a drop generator according to the present invention.
Figure 3B:
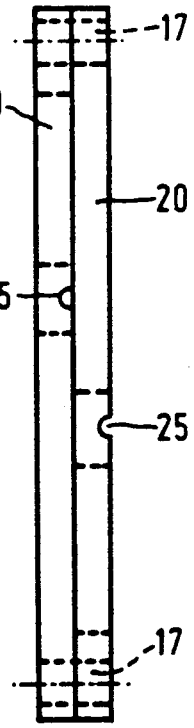
FIG. 3*b* is a side view of the elements of FIG. 3*a*.

To form a drop generator the element 10 is applied against an element 20 (FIGS. 3*a* and 3*b*). Element 10 is situated beneath element 20 in FIG. 3*a* as seen in FIG. 3*b*. The element 10 is shown in broken lines. Fixing elements in the form of screws or the like are inserted through the openings 17. In this way the pressure chamber 11 is situated against the flat rear surface of element 20 and element 20 thus forms an ink-sealing side wall for chambers 11 and 12 and for the nozzle 15. Similarly, the flat top surface of element 10 forms a seal for the chambers 21 and 22 of element 20. By stacking a large number of alternate elements 10 and 20, a stacked drop generator is obtained in which all the side edges of the chambers and the side edges of the nozzles are sealed off by the flat sides or surfaces of the adjoining elements.

The drop generator described in reference to FIG. 3*c* is made up of two groups of identical elements (10 and 20), in which two elements of a group are always separated by an element of the other group. In order to be able to provide an entire group of elements 10 or 20 with ink, passage openings 18 and 28, are provided in elements 10 and 20, respectively. Thus, all of the pressure chambers 11 can be provided with ink via the side edges of the drop generator by way of supply chambers 12 and passage openings 28. Similarly, the pressure chambers 21 can be provided with ink by way of the ink supply chambers 22 and passage openings 18.

To obtain an even better seal between the elements, a very thin insulating foil ($\pm 5$ $\mu$m) can be provided between each two elements, with the openings 12, 18 or 22 and 28 being formed therein. Another method of obtaining a good seal is to punch out the chambers in the elements, after which small upright edges, of a size of about 10 $\mu$m, are formed on either side of the element around the chambers by means of mold pressing. Sealing is obtained by locally exceeding the surface pressure.

The lay-out of element 10 is so selected that element 20 is obtained by turning this element over. With this drop generator one group (type) of elements is sufficient, provided they are mounted in the correct direction.

Since the piezo-elements 13, 23 and the pressure chambers 11, 21 do not overlap, minimum cross-talk occurs between the two pressure chambers 11 and 21.

Figure 4A:
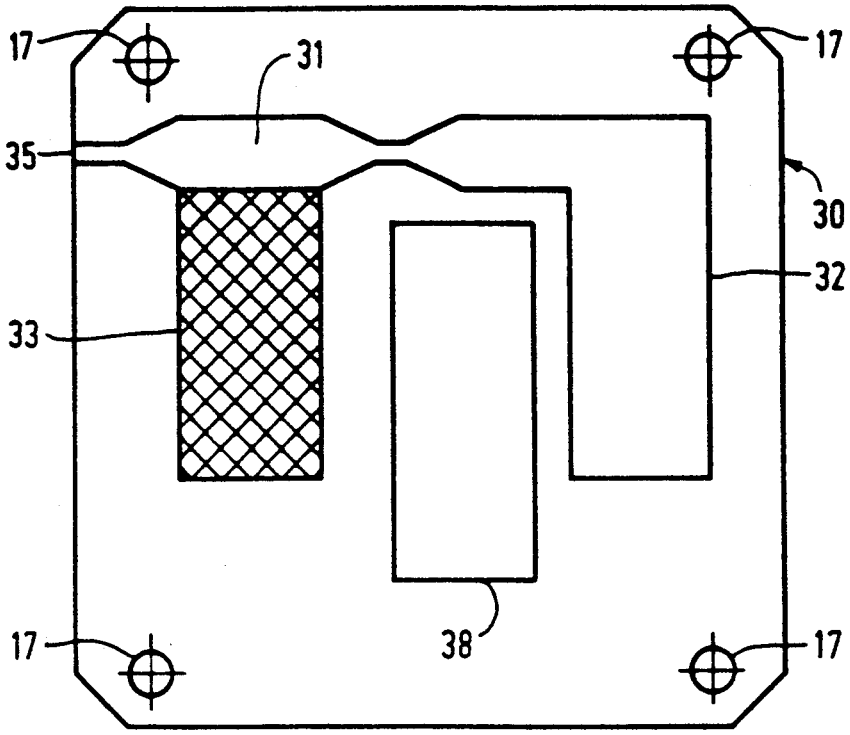
FIGS. 4*a* and 4*b* show alternate embodiments of elements of a drop generator according to the present invention, FIGS. 5*a* and 5*b* diagrammatically illustrate a drop generator viewed in the direction of the nozzles.
Figure 4B:
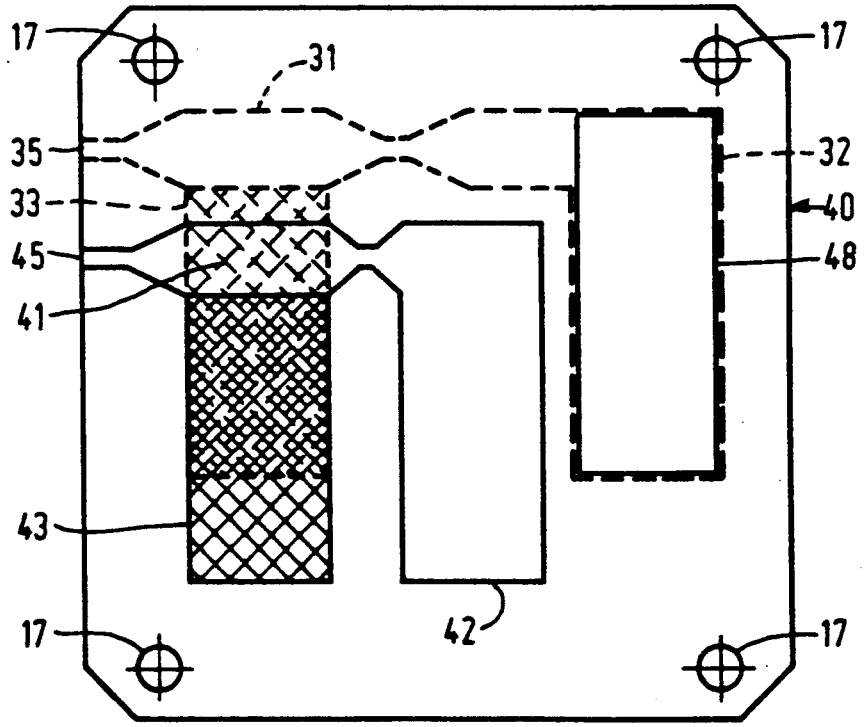

It has, however, been found that the piezo-elements may overlap with one another while still maintaining good cross-talk suppression. In order to achieve this, however, the pressure chambers should not overlap, i.e. The pressure chambers of adjacent elements must not be in line. This feature has been used in a drop generator according to the invention made up of elements 30 and 40, as shown in FIGS. 4*a* and 4*b*. In this configuration, a pressure chamber 31, nozzle 35, supply chamber 32, piezo-element 33 and passage opening 38 are provided in a first group of elements 30, as shown in the drawing. Analogous with FIG. 3*a*, this element is shown in broken lines beneath a second element 40 forming a part of a second group of elements 40 as seen in FIG. 4*b*. Element 40 also contains a supply chamber 42, pressure chamber 41, nozzle 45, piezo-element 43 and a passage opening 48.

The piezo-elements 33 and 43 overlap, but the pressure chambers 31 and 41 do not overlap. Thus good cross-talk attenuation is realized while the elements can be made separately smaller than, for example, the elements 10 and 20 in FIGS. 2 and 3. It is also possible to give up this small reduction, for example, to enable a larger piezo-element 33, 43 to be provided in the elements, so that the pressure waves in the ink chamber can be larger or so that a lower control voltage can be used for an identical pressure wave.

When stacked, the supply chambers 32 and 42 in FIG. 4*b* are separated from one another, for example to enable two colors of ink to be sprayed by the drop generator. This means that each group of identical elements contains an ink supply chamber which has no communication with a supply chamber of the elements of another group. Each element of a group then has passage openings which, after stacking, are in line with the supply chambers of the elements of another group. It is, of course, also possible to supply identical inks to these supply chambers. When only one color of ink is to be sprayed, the lay-out of, for example, supply chamber 42 of element 40 can be so selected that, when stacked with an element 30, it is exactly in line with the supply chamber 32 of the element 30.

Figure 5A:
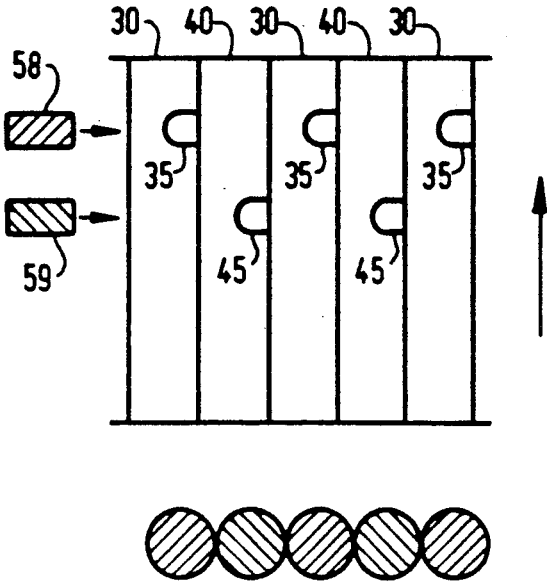

If two inks of different colors are to be sprayed with a stacked drop generator, as shown in FIG. 4*b*, then the colored drops will not fall exactly on one another, but next to one another, on a sheet of paper moving past the nozzles. This is shown in FIG. 5*a*, in which a number of elements are disposed next to one another and which shows a front view of the nozzles. In the elements 30 and 40 the nozzles are all disposed on the right-hand side of the element.

Figure 5B:
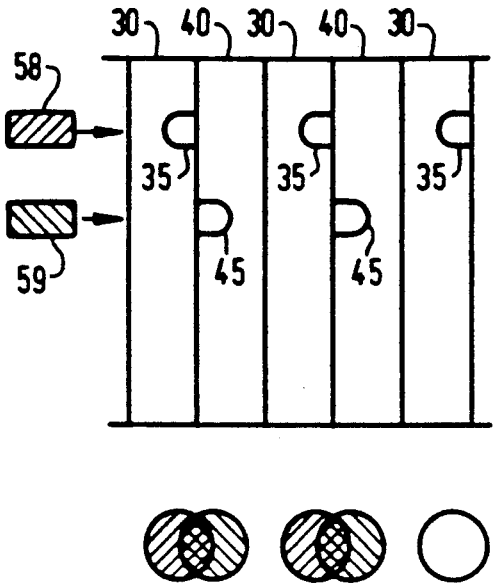

Beneath the row of elements the drops are shown as being deposited on a sheet of paper if ink 58 is supplied to elements 30 and ink 59 to elements 40. This is not an optimal result, particularly for producing mixed colors. FIG. 5*b* shows a better solution for producing mixed colors. Here the nozzles 35 in the elements 30 are disposed on the right and the nozzles 45 in the elements 40 on the left. The drops from adjacent elements 30 and 40 will largely overlap (mixed drops). A disadvantage that occurs under these conditions is that the space between two mixed drops is increased. This disadvantage can be largely obviated by spraying larger drops.

Figure 6:
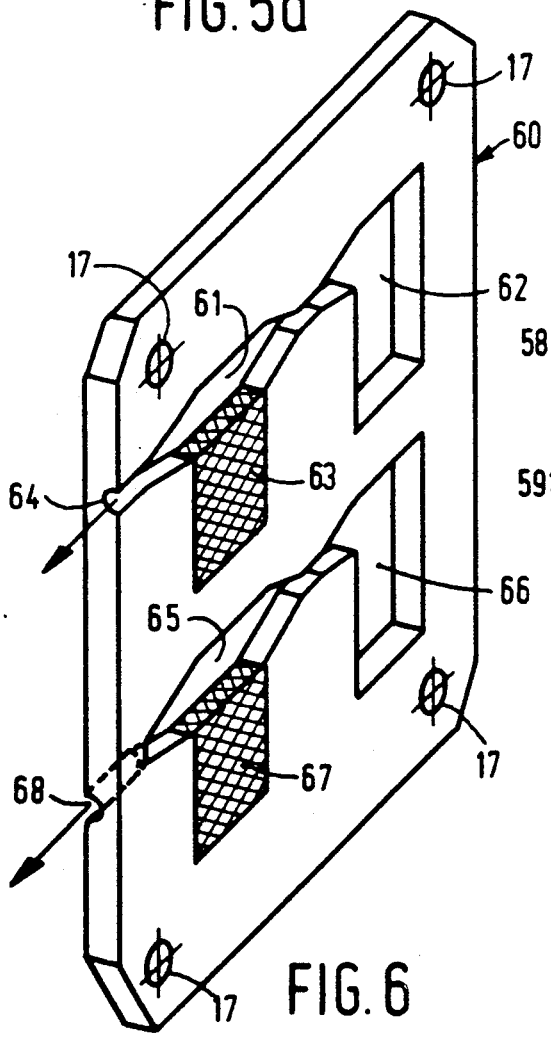
FIG. 6 shows still another element of a drop generator according to the present invention.

FIG. 6 shows another solution for making mixed drops. Two separate pressure chambers 61, 65, supply chambers 62, 66 and piezo-elements 63, 67, are provided in an element 60. The nozzle 64 has a channel on the right of the elements 60 and nozzle 68 has a channel on the left of element 60. The mixed drops sprayed with this element will have approximately the appearance shown in FIG. 5*b*.

Figure 7:
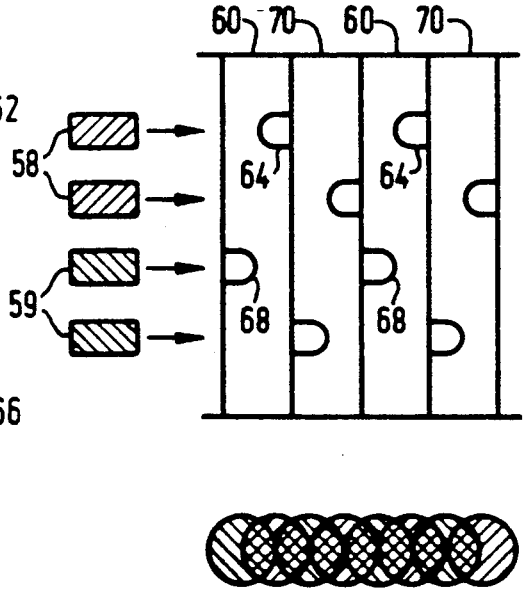
FIG. 7 is a diagrammatic view in the direction of the nozzles of a drop generator according to the present invention.

When element 60 is stacked with an element 70 of comparable construction as in FIG. 7 but in which the pressure chambers are at a lower level than the pressure chambers 61, 65 in element 60, as is essential according to the instant invention, analogous with FIGS. 5*a* and 5*b*, good overlapping of the drops is obtained and the distance between the mixed drops is also greatly reduced in comparison with FIG. 5*b*.

Figure 8:
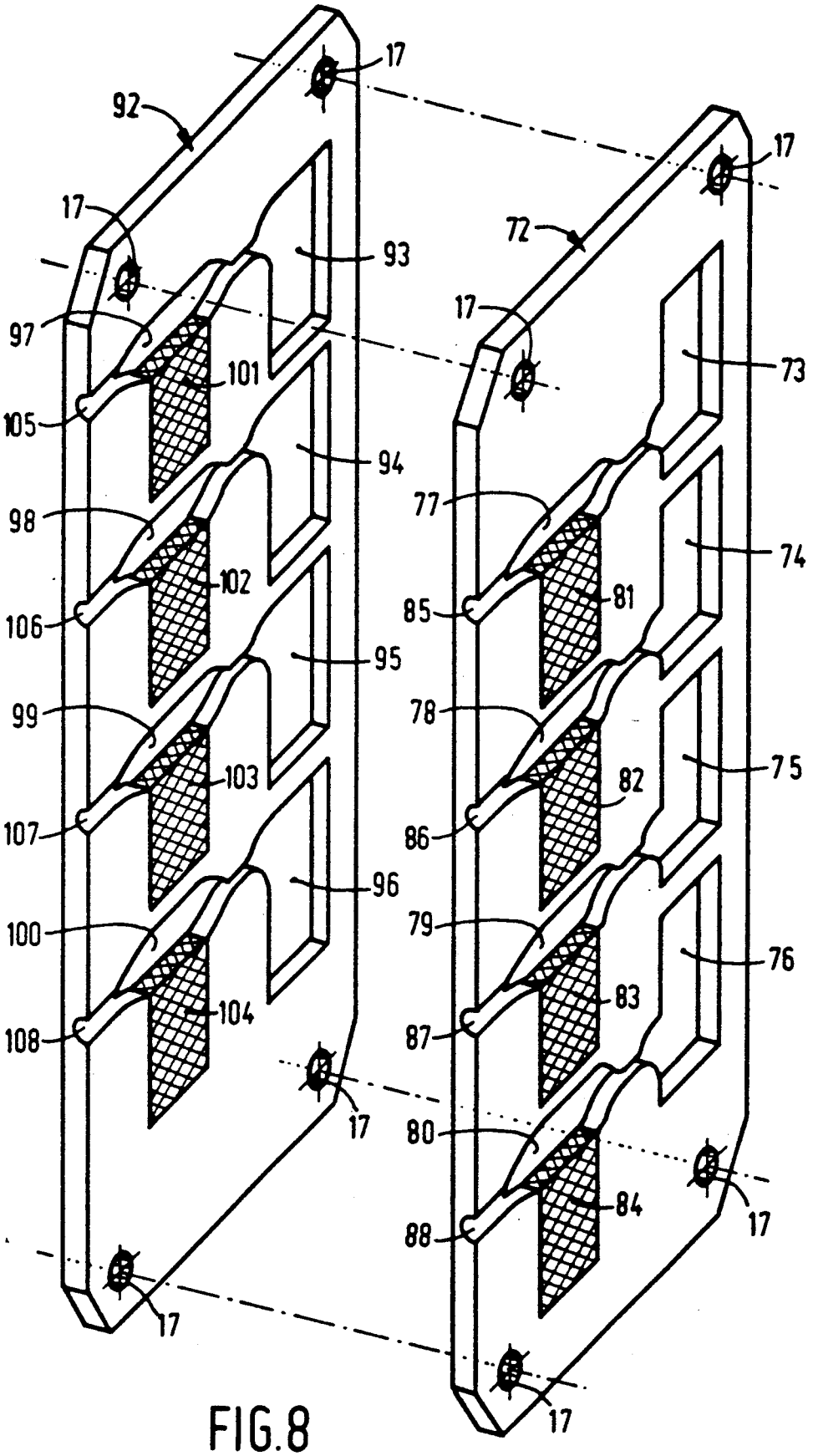
FIG. 8 shows stackable elements for making color prints.

FIG. 8 shows two elements 72, 92 for making a stackable drop generator with which it is possible to produce full-color prints. The element 72 of a first group of elements comprises four supply chambers 73–76, four pressure chambers 77–80, four piezo-elements 81–84 and four nozzles 85–88. Similarly, element 92 of a second group of elements comprises four supply chambers 93–96 which are exactly in line with the supply chambers 73–76 of element 72. Element 92 also comprises four pressure chambers 97–100, four piezo-elements 101–104, and four nozzles 105–108. According to the invention, the pressure chambers of two neighboring elements 72 and 92 are not on the same line.

To make full-color prints, the supply chambers 73 and 93 are filled with ink in the color cyan, supply chambers 74 and 94 with magenta ink, supply chambers 75 and 95 with yellow ink and supply chambers 76 and 96 with black ink. The nozzles of each element 72, 92 are disposed on the right of the elements. They can also be offset per element. For example the nozzles, 85, 87 and 105, 107 may be disposed on the right and the nozzles 86, 88 and 106, 108 on the left.

It is clear that an ink-jet printer provided with a stackable drop generator according to the present invention must be so controlled as to give image-wise prints. For this purpose, a receiving sheet is processed past the drop generator at a uniform speed. The image signals originating, for example, from a document are converted into actuation signals for the various piezo-elements, so that the drops are ejected from the nozzles.

Since the nozzles, as considered in the direction of transit of a receiving sheet, are situated consecutively in two or more rows, the image signal originating from one scan line on the document will in a known manner be split into signals which are fed directly to the first row and signals which are fed to the second row with some delay. The delay can be produced easily by temporarily storing the signals in a shift register and feeding them at the correct time to the piezo-elements of the second row by means of clock signals derived from the movement of the receiving sheet.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A stackable drop generator configuration for an ink-jet printer comprising a plurality of adjacent stackable elements in the form of flat plates, each element comprising a complete self-contained ink-jet system including a pressure chamber, an ink supply chamber communicating therewith, the pressure chamber being disposed with an opening throughout said element, a piezo-element for forming a pressure wave in ink in said pressure chamber, a nozzle with an inlet which leads into said pressure chamber and an outlet through which ink drops can be ejected from said pressure chamber, and openings which are in line with corresponding openings in each adjacent element through which fixing means can be disposed in order to enable a plurality of said elements to be accurately stacked, said elements being so disposed such that said pressure chambers of alternating elements do not overlap.

2. A stackable drop generator configuration according to claim 1, wherein said configuration is made up of a plurality of groups of identical elements, in which at least two elements of a first group are separated by an element of a second group.

3. A stackable drop generator according to claim 2, wherein identical elements of said first group provide a common ink supply chamber which does not communicate with a similar common supply chamber of elements of said second group, and in which each element of said first group has at least one passage opening in line with said ink supply chamber or chambers of said elements of said second group.

4. A stackable drop generator configuration according to any one of claims 1 or 2 or 3, wherein each element of said configuration comprises at least two separate pressure chambers, piezo-elements and nozzles.

5. A stackable drop generator according to any one of claims 1 or 2 or 3, wherein said nozzle is formed as a channel provided in one side of a respective element.

6. A stackable drop generator according to claim 3, further including a thin insulating foil disposed between at least two elements of said plurality of stackable elements, said foil being provided with openings corresponding to said supply chambers and said passage openings.

7. A stackable drop generator according to claim 1, wherein said respective elements are provided with upright edges around said chambers whereby sealing is obtained by localized surface pressure.

8. The stackable ink drop generator configuration of claim 1, wherein said piezo-element of said flat plate element further includes evaporation-applied electrodes on externally facing sides, one of said electrodes being connected to said element and another of said electrodes having a thin connecting foil to an exterior of said element through a cavity formed in a surface of said element.

9. A stackable ink drop generator as in claim 1, wherein each of said nozzles of said plurality of elements is formed as a channel in a same side of each element.

10. A stackable ink drop generator as in claim 1, wherein each of said nozzles of said plurality of elements is formed as a channel alternately in opposite sides of respective elements.

11. A stackable ink drop generator as in claim 4, wherein each element of said configuration comprises two separate pressure chambers, piezo-elements and nozzles, each of said nozzles of each element being formed as a channel offset on opposite sides of said respective element.

12. A stackable ink drop generator as in claim 4, wherein each element of said configuration comprises four separate pressure chambers, piezo-elements and nozzles, said nozzles of each element being formed as channels on a same side of each element.

13. A stackable ink drop generator as in claim 12, wherein said nozzles of each element are alternately offset on opposite sides of said element.

14. A stackable ink drop generator as in claim 12, wherein said pressure chambers of adjacent elements are not aligned.

15. An ink-jet printer comprising a stackable drop generator including a plurality of stackable elements in the form of flat plates, each element comprising a complete self-contained ink-jet system including a pressure chamber, an ink supply chamber communicating therewith, the pressure chamber being disposed with an opening throughout said element, a piezo-element for forming a pressure wave in ink in said pressure chamber, a nozzle with an inlet which leads into said pressure chamber and an outlet through which ink drops can be ejected from said pressure chamber, and opening which are in line with corresponding opening in each adjacent element through which fixing means can be disposed in order to enable a plurality of said elements to be accurately stacked, said elements being so disposed such that said pressure chambers of alternating elements do not overlap.

16. An element for use in a stackable drop generator, comprising a complete self-contained ink-jet system including a pressure chamber, an ink supply chamber communicating therewith, the pressure chamber being disposed with an opening throughout said element, a piezo-element for forming a pressure wave in ink in said pressure chamber, a nozzle with an inlet which leads into said pressure chamber and an outlet through which ink drops can be ejected from said pressure chamber, and openings which can be placed in line with corresponding openings in an adjacent element through which fixing means can be disposed in order to enable a plurality of said elements to be accurately stacked.

17. An element according to claim 16, which comprises at least two separate pressure chambers, piezo-elements and nozzles.

18. An element according to claim 16, wherein said nozzle is formed as a channel provided in one side of said element.

* * * * *